United States Patent [19]

Lipkin et al.

[11] Patent Number: 5,010,350

[45] Date of Patent: Apr. 23, 1991

[54] ANTI-ICING AND DE-ICING SYSTEM FOR REFLECTOR-TYPE MICROWAVE ANTENNAS

[75] Inventors: Charles L. Lipkin, Naperville; Marianne Jones, Lockport, both of Ill.

[73] Assignee: Andrew Corporation, Orland Park, Ill.

[21] Appl. No.: 421,173

[22] Filed: Oct. 13, 1989

Related U.S. Application Data

[63] Continuation-in-part of Ser. No. 130,809, Nov. 25, 1987, abandoned.

[51] Int. Cl.[5] ..... H01Q 1/02

[52] U.S. Cl. ..... 343/704; 343/912

[58] Field of Search ..... 343/704, 840, 912

[56] References Cited

U.S. PATENT DOCUMENTS

| | | | |
|---|---|---|---|
| 2,679,003 | 5/1954 | Dyke et al. | 343/704 |
| 4,866,452 | 9/1989 | Barma et al. | 343/704 |

FOREIGN PATENT DOCUMENTS

| | | | |
|---|---|---|---|
| 52-02252 | 1/1977 | Japan | 343/704 |
| 57-208702 | 12/1982 | Japan | 343/704 |
| 57-208703 | 12/1982 | Japan | 343/704 |

*Primary Examiner*—Michael C. Wimer
*Assistant Examiner*—Hoanganh Le
*Attorney, Agent, or Firm*—Kareem M. Irfan

[57] ABSTRACT

An improved anti-icing and de-icing system is provided for reflector-type microwave antennas having a paraboloidal reflector and an associated feed horn for launching microwave signals onto the reflector and receiving microwave signals from the reflector. The improved system comprises a non-conductive, insulated enclosure forming an enclosed cavity adjacent the rear side of the reflector, and a radiant heating system disposed within the enclosure for heating the rear side of the reflector with radiant energy, whereby the air in said cavity is in turn heated by heat transferred to said air from the rear side of the reflector. The radiant heating system comprises at least one infra-red heating source, and is supplemented by a highly reflective mirror coating disposed on the inside surface of the insulated enclosure behind the heating source to direct the radiant energy emanating from the back of the heating source of all regions of the reflector. Sections of highly reflective mirror coating are also provided in regions of the rear surface of the reflector immediately opposing the front side of the heating source to divert excess radiant energy emanating from the front of the heating source and disperse it to all regions of the reflector.

11 Claims, 5 Drawing Sheets

ANTI-ICING AND DE-ICING SYSTEM FOR REFLECTOR-TYPE MICROWAVE ANTENNAS

This is a continuation-in-part of co-pending application U.S. Ser. No. 07/130,809 filed on Nov. 25, 1987, now abandoned.

FIELD OF THE INVENTION

The present invention relates generally to reflector-type microwave antennas and, more particularly, to a unique anti-icing and de-icing system for such antennas.

DESCRIPTION OF RELATED ART previous anti-icing or de-icing systems for microwave antennas have used either direct electrical heating or forced hot air heating. In the direct electrical heating systems, electrical power is supplied to insulated flexible heating elements in the form of strips, panels or mats attached directly to the rear surface of the reflector. Heat generated by the heating elements is transferred directly to the reflector, and then throughout the reflector, by conduction. Such heating systems are relatively expensive and are extremely difficult to install in the field. The interface between the heating elements and the reflector is sensitive to irregularities in the reflector surface, and any imperfection in the adhesive bond between the heating element and the reflector allows water to penetrate into the interface. Such water penetration reduces the effective heat transfer to the reflector, degrades the adhesive bond, and eventually leads to delamination of the heating element from the reflector.

In the forced air systems, heated air is blown into and/or circulated around a plenum formed by an enclosure attached to the rear side of the reflector. The air is heated by electrical resistance heaters, or by combustion of a fuel such as oil or gas. The warm air heats the reflector by convection and conduction. These hot air systems are relatively expensive, require ducting for the heated air (and the exhaust fumes if the air is heated by fuel combustion), and require a blower to force the heated air into and/or circulate the warm air around the plenum.

SUMMARY OF THE INVENTION

It is a primary object of the present invention to provide an improved anti-icing and de-icing system for reflector-type microwave antennas, which can be fabricated at a substantially lower cost than other anti-icing and de-icing systems for such antennas.

It is an important object of this invention to provide such an improved anti-icing and de-icing system which can be easily installed either during manufacture of the antenna or in the field.

It is a further object of this invention to provide such an improved anti-icing and de-icing system which does not require any fuel combustion nor exhaust ducts nor blowers and, therefore, is extremely quiet.

Yet another object of this invention is to provide such an anti-icing and de-icing system which does not require any critical or sensitive attachments to the reflector skin.

A further object of this invention is to provide such an anti-icing and de-icing system which is highly efficient in its consumption of energy and highly sensitive in its distribution of energy for heating the antenna reflector.

Still another object of this invention is to provide such an improved anti-icing and de-icing system which requires little maintenance and service and has a long operating life.

Other objects and advantages of the invention will be apparent from the following detailed description and the accompanying drawings.

In accordance with the present invention, the foregoing objectives are realized by providing an improved anti-icing and de-icing system for reflector-type microwave antennas having a paraboloidal reflector and an associated feed horn for launching microwave signals onto the reflector and receiving microwave signals from the reflector, the system comprising a non-conductive, insulated enclosure forming an enclosed cavity adjacent the rear side of said reflector, and radiant heating means within said enclosure for heating the rear side of said reflector with radiant energy, whereby the air in said cavity is in turn heated by heat transferred to said air from the rear side of said reflector.

In its preferred form the radiant heating means comprises at least one infra-red heating source, and includes a highly reflective mirror coating disposed on the inside surface of the insulated enclosure behind the heating source to direct the radiant energy emanating from the back of the heating source to all regions of the paraboloidal reflector. Smaller additional areas of highly reflective mirror coating are placed on the rear surface of the paraboloidal reflector itself immediately in front of the heating source to divert excess radiant energy emanating from the front of the heating source and to disperse it to all regions of the paraboloidal reflector.

DESCRIPTION OF THE PREFERRED EMBODIMENT

Figure 1:
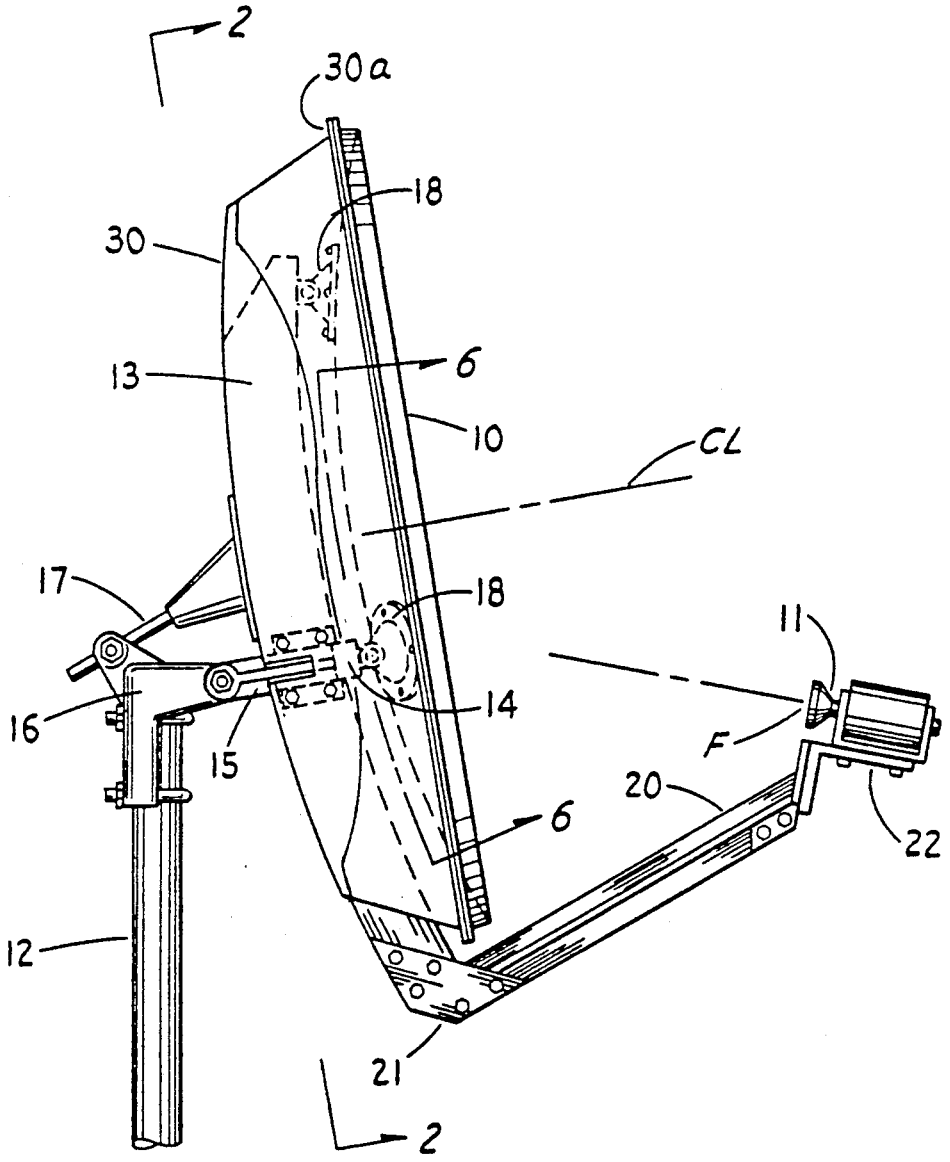
FIG. 1 is a side elevation of a reflector-type microwave antenna having an anti-icing and de-icing system embodying the invention.

While the invention is susceptible to various modifications and alternative forms, certain preferred embodiments thereof have been shown by way of example in the drawings and will be described in detail. It should be understood, however, that it is not intended to limit the invention to the particular forms described, but, on the contrary, the intention is to cover all modifications, equivalents, and alternatives falling within the spirit and scope of the invention as defined by the appended claims.

Turning now to the drawings and referring first to FIG. 1, the illustrative antenna includes a paraboloidal reflector 10 for reflecting both transmitted and received microwave signals between a remote station and a feed horn 11. The reflector 10 is preferably biaxially stretch formed, stamped or hydro-formed from an aluminum disc or sheet, with the periphery of the disc being bent rearwardly and then outwardly to stiffen the reflector. The feed horn 11 is located at the focal point F of the paraboloid which defines the concave surface of the reflector 10. The horn 11 is supported by an L-shaped bracket 22 disposed on the end of a boom 20. The boom 20 is cantilevered from the bottom of a vertical beam 13 and connected to the beam by a pair of gussets 21 bolted to the beam and the boom. As can be seen in FIG. 1, the illustrative antenna is of the "offset" type wherein the focal point F of the paraboloidal surface is offset from the center line CL of the antenna aperture.

On the rear side of the reflector, the antenna is mounted on a vertical post 12 by a framework which includes the curved vertical beam 13 and a pair of side arms 14 extending laterally from opposite sides of the beam 13. The two side arms 14, which are preferably aluminum castings, are bolted rigidly to opposite sides of the vertical beam 13, which is suitably formed from rectangular aluminum tubing. The outer ends of the two side arms 14 and the upper end of the vertical beam 13 are fastened to the rear side of the reflector 10.

The side arms 14 also include rearwardly extending flanges 15 for pivotally securing the antenna to a mating mount casting 16 fastened to the top of the post 12. This pivotal mounting facilitates aiming of the antenna by permitting the antenna to be readily adjusted in elevation by means of an adjustment strut 17. When the antenna has been adjusted to the desired elevation, the flanges 15 are locked rigidly to the mount casting 16 by tightening a nut on a bolt which is passed through the flanges and the mount casting.

The outer ends of the two side arms 14 and the upper end of the vertical beam 13 are fastened to the rear side of the reflector at three spaced mounting locations, and the fastening means at each of these three locations includes swivel means for permitting relative tilting movement between the frame members and the reflector surface before the fastening means is tightened. Thus, the outer ends of the side arms 14 and the upper end of the vertical beam 13 are fastened to support members 18 on the rear side of the reflector. The details of this mounting and support structure are described in U.S. Pat. No. 4,819,007, issued Apr. 4, 1989, and assigned to the assignee of the present invention.

In accordance with one important aspect of the present invention, the illustrative antenna includes an anti-icing and de-icing system comprising a non-conductive insulated enclosure forming an enclosed cavity adjacent the rear side of the reflector, and a radiant heat source within the enclosure for heating the rear side of the reflector with radiant energy. The radiant heat source does not directly heat the air in the cavity, but rather heats the rear surface of the reflector. Heat is then transferred through the reflector to its front surface, and throughout the reflector, by conduction. Heat is also transferred from the rear surface of the heated reflector into the air in the enclosed cavity by conduction and free convection. The non-conductive enclosure minimizes heat losses from the enclosed cavity so that the warm air in the cavity provides a stable, uniform temperature over the entire area of the reflector.

Figure 2:
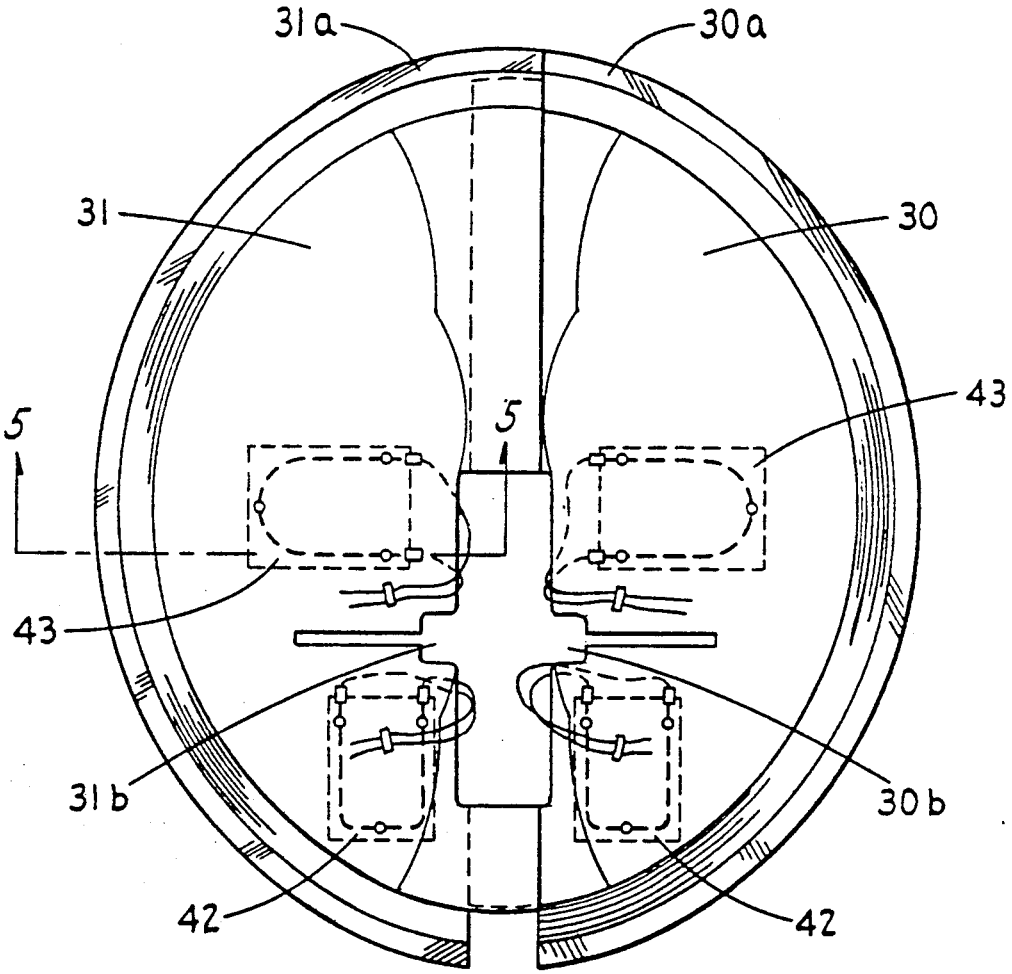
FIG. 2 is a vertical section taken generally along line 2—2 in FIG. 1 to provide a rear elevation view of the major portion of the antenna structure.
Figure 4A:
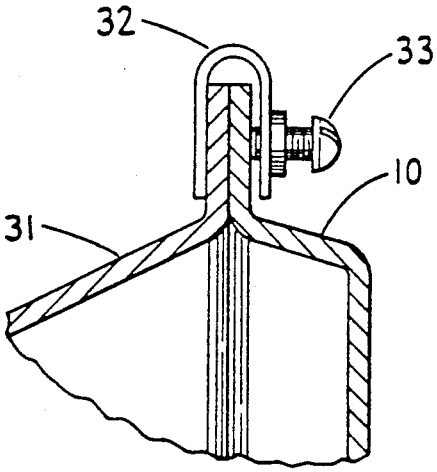
FIG. 4A and FIG. 4B are enlarged sections taken generally along line 4—4 in FIG. 3A.
Figure 4B:
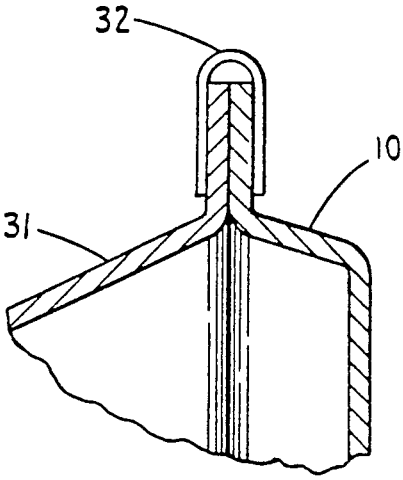

In the illustrative embodiment, the non-conductive enclosure is formed by two insulating panels 30 and 31 attached to the periphery of the reflector 10 and to each other. The panels 30 and 31 are relatively rigid and are preferably made by molding a polymeric material such as ABS (acrylonitrile-butadiene-styrene) or a fiberglass-reinforced polymer. As shown in FIGS. 1 and 2, each panel 30 and 31 is of generally semi-circular shape with a contour generally parallel to that of the rear surface of the reflector. The outer periphery of each panel 30 and 31 terminates in an outer flange **30*a* or 31*a* which fits flat against the outer lip of the reflector 10. To fasten the flanges 30*a* and 31*a* to the reflector lip, a plurality of U-shaped clips 32 are inserted over the outer edges of the two adjoining members and fastened thereto by clamping screws 33, as shown in FIG. 4A. Alternatively, a plurality of U-shaped spring clips requiring no clamping screws can be used, or a single long flexible U-shaped spring strip can be clamped over the entire outer flange (see FIG. 4A**).

Figure 5A:
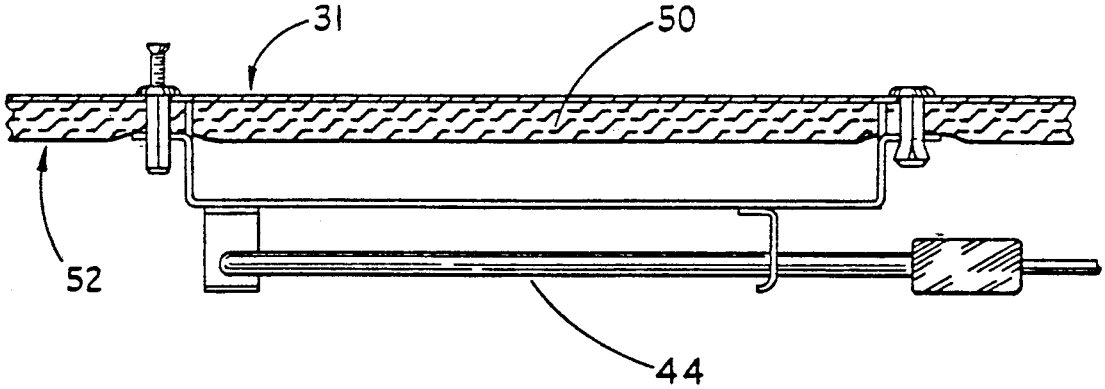
FIG. 5A and FIG. 5B are enlarged sections taken generally along line 5—5 in FIG. 2.

In order to retard the loss of heat from within the cavity to the atmosphere outside the enclosure, the inside, surface (i.e., the concave surface) of each of the panels 30 and 31 is lined with heat insulating material 50 (see FIG. 5A). The insulating material 50 may be any suitable non-conductive heat retardant material, such as fiberglass batts, polystyrene foam sheets or polyurethane foam sheets. Alternatively, the panels 30 and 31 may themselves be made of material which is sufficiently insulating so that no additional insulating material lining is needed.

The insulating enclosure is formed in two parts (i.e., by the two panels 30 and 31) to enable it to be installed over the supporting framework for the reflector 10. Thus, each of the panels 30 and 31 has a slot **30*b* or 31*b* extending outwardly from the inner edge of the panel to enable the panel to fit over the flanges 15 which connect the side arms 14 to the mount casting 16 (see FIG. 2). After the panels are in place, those portions of the slots 30*b* and 31*b* not occupied by the flanges are covered with access cover plates 36*a* and 36*b* which are fastened to the panels 30 and 31 by a plurality of screws 37**.

Figure 3A:
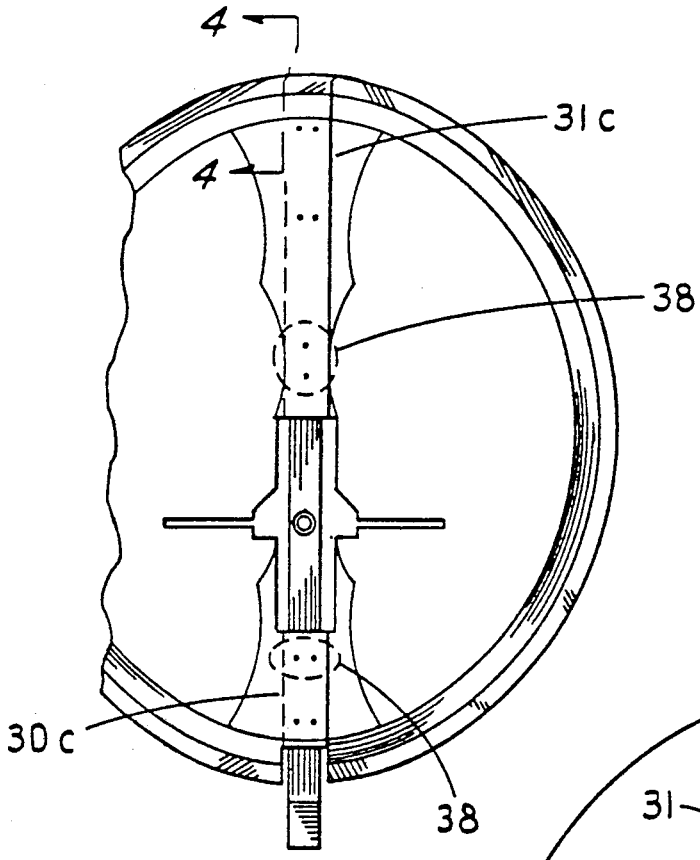
FIG. 3A and FIG. 3B are vertical sections as in FIG. 2 illustrating additional structural details.

As shown in FIG. 3A, the adjoining inner edges of the panels 30 and 31 are attached to the curved vertical beam 13 at their adjacent edges **30*c* and 31*c* which overlap each other. A plurality of screws 38 are used to fasten the two panel edges 30*c* and 31*c* to the curved vertical beam 13**.

To provide a radiant heat source inside the cavity formed by the insulating enclosure, the two panels 30 and 31 are provided with infra-red heating units 42 and 43. These heating units are mounted on the inside surfaces of the panels 30 and 31, and each unit contains at least one electrically powered infra-red heating lamp or metal element 44 which extends into the cavity between the panels and the reflector for a short distance in front of the insulation 50 (see FIG. 2 and FIG. 5A). The infra-red lamps or metal elements 44 are thus spaced some distance away from the rear surface of the paraboloidal reflector, so that when the lamps or metal elements 44 are energized, they emit infra-red energy which illuminates a broad area of the region of the rear surface of the reflector 10 opposite the lamps.

The use of infra-red heating lamps or metal elements 44 is advantageous in that these lamps or elements emit radiant energy over a range of directions. Heating lamps concentrate most of their emitted radiant energy in front of the lamp, whereas metal elements spread their emitted radiant energy more evenly in all directions. In either case, but especially in the case of the heating lamps, the relative proximity of the rear surface of the paraboloidal reflector to the heating lamp or the metal element would result in too much radiant energy being directed to the relatively small region of the paraboloidal reflector surface immediately opposed to them (see FIG. 5A). Consequently, these small regions of the paraboloidal reflector would get too hot, and the rest of the paraboloidal reflector would remain too cool, resulting in inefficient use of the radiant energy supplied by the radiant heating units 42 and 43. This would cause slower melting of the snow and ice on the front of the reflector surface than could be obtained optimally, and possible distortion of the shape of the paraboloidal reflector surface due to non-uniform temperature effects.

Figure 5B:
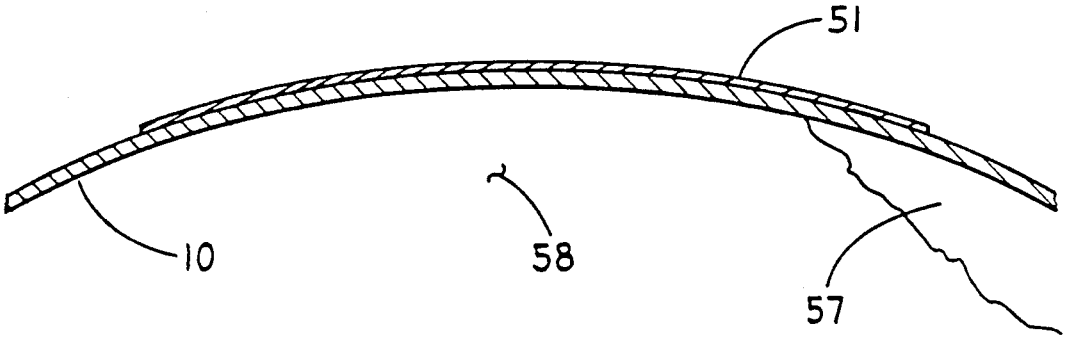
Figure 6:
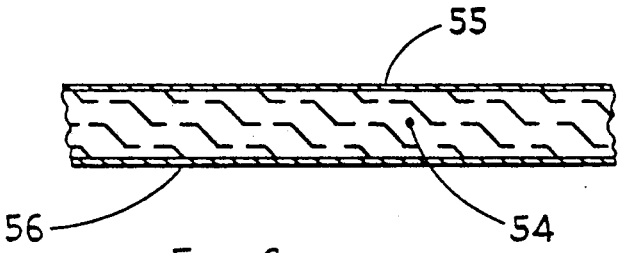
FIG. 6 is an enlarged cross section of an exemplary insulated sandwich-type sheathing for use with the antenna of FIGS. 1-5.
Figure 7:
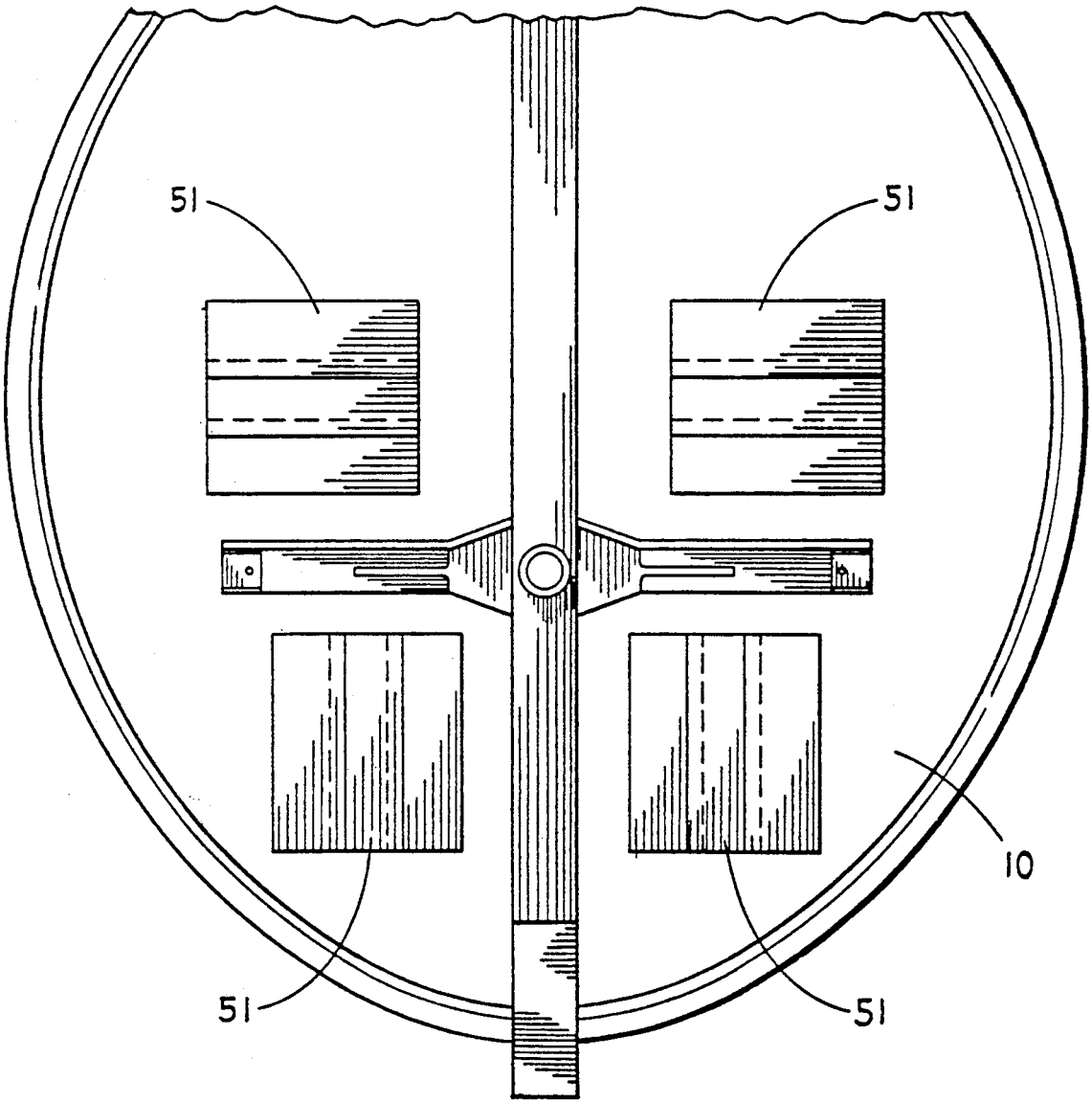
FIG. 7 is a detailed view of a vertical section taken generally along line 6—6 in FIG. 1.

In accordance with a feature of this invention, these problems are avoided, and more even distribution of the radiant energy is ensured over all of the rear surface of the paraboloidal reflector, by the provision of means for directing the radiating energy emanating from the heat source to all regions of the paraboloidal reflector. More specifically, the small regions of the rear surface of the paraboloidal reflector 10 immediately opposed to the radiant heating units 42 and 43 are coated with a highly reflective mirror surface material, as shown in FIG. 5B and FIG. 6. Preferably, the coating is formed of aluminum foil tape or glossy silver paint, or other like material which is highly reflective to infra-red radiation. The small regions of reflective mirror surface material 51 immediately opposed to the radiant heating units 42 and 43 reflect away most of the radiant energy impinging on these small regions, scattering this energy to broad regions of the insulation material 50 covering the inside surface of the enclosure panels 30 and 31. This prevents the small regions of the paraboloidal reflector from over-heating.

In order to further enhance the efficient distribution of radiant energy over the entire rear surface of the paraboloidal reflector 10, the surface of the insulation material 50 covering the inside surfaces of the enclosure panels 30 and 31 that face the inside of the enclosure is also coated with highly reflective mirror surface material 52 (see FIG. 5A). If the panels 30 and 31 are themselves made of sufficiently insulating material, so that no additional insulating material lining 50 is required, the inside surfaces of the panels 30 and 31 themselves are coated with highly reflective mirror surface material 52. This can be accomplished using aluminum foil tape, glossy silver paint, or large sheets of aluminum foil which are either self-adhesive or attached with cement.

The insulating material 50 and the highly reflective mirror surface material 52 may also be combined into a single item, insulated sheathing 53, which, as shown in FIG. 6, is a sheet type sandwich material consisting of an insulating material core with highly reflective mirror surface material on one or both of its faces. One such type of combined material which is commercially available is Celotex Tuff-R® insulating sheathing, which consists of a semi-rigid polyisocyanurate foam board insulation 54 with a reinforced aluminum foil facer 55 on the printed side and a solid aluminum foil facer 56 on the other side. Other similar types of such insulated sheathing 53 are also available and may be used just as conveniently. Typically, the foam board core 54 comprises the insulation material and the solid aluminum foil facer side 56 comprises the highly reflective mirror surface material. The reinforced aluminum foil facer side 55 is placed against the inside surface of the panels 30 and 31, and the insulated sheathing 53 is attached thereto using cement, rivets, screws, nuts and bolts, or any other suitable fixing device, material, or combination thereof.

With the above-described arrangement, the radiant energy emitted by the infra-red heating lamps or metal elements 44 in directions other than towards the rear surface of the paraboloidal reflection 10, and the radiant energy reflected away from the paraboloidal reflector regions immediately opposed to the infra-red heating units by the highly reflective mirror surface material 51 coating these small regions, impinges on the highly reflective mirror surface material 52 coated on the inside surfaces of the insulated panels 30, 31 which form the entire back of the enclosure. Most of this incident radiant energy is reflected away and scattered over the entire rear surface of the paraboloidal reflector 10, where it is primarily absorbed, thereby efficiently heating the paraboloidal reflector.

The air inside the cavity, which is normal atmospheric air, remains essentially unheated by the radiant energy because the air is virtually transparent to the short-wavelength infra-red radiant energy emitted by the radiant heating units 42 and 43. The opaque rear surface of the paraboloidal reflector 10, however, does absorb a substantial portion of the radiant energy incident upon it and is thereby heated in accordance with the Stefan-Boltzman law. That portion of the incident radiant energy which is not absorbed by the paraboloidal reflector 10 is reflected therefrom and impinges on the other metal components of the antenna within the enclosure formed by the panels 30 and 31, and also upon the highly reflective mirror surface material 52 coating the inside of the panels or the insulation 50. Since all of these surfaces are also opaque, the radiant energy is again partially absorbed and partially reflected at these surfaces. Virtually all of this radiant energy is reflected by the highly reflective mirror surface material 52.

This process of absorbing and reflecting the incident radiant energy is repeated at each successive impingement with a surface. Since the cavity is essentially totally enclosed, virtually no portion of the radiant energy can escape. Accordingly, the process continues until all of the radiant energy is absorbed by the interior surfaces of the enclosure, mainly the rear surface of the paraboloidal reflector 10 and the other metal components of the antenna within the enclosure.

As the paraboloidal reflector and the other metal components of the antenna within the enclosure become heated, some of the radiant energy absorbed by these surfaces is re-emitted into the cavity as longer wavelength infra-red radiation; this radiation does heat the air in the enclosure to some extent. Also, the heated rear surface of the paraboloidal reflector and the heated surfaces of the other metal components of the antenna within the enclosure warm the air in the cavity by natural conduction and convection, since these surfaces tend to be at a higher temperature than the air in the cavity. The air thus warmed circulates within the enclosure by natural un-forced convection, and acts to further insulate the rear surface of the paraboloidal reflector 10 and to stabilize the temperature thereof to a uniform level.

It should be noted that the use of radiation as the primary heat transfer means for heating the paraboloidal reflector provides a substantial advantage over the prior art conduction and/or convection means of doing so, particularly for antennas intended for outdoor use. In radiant heat transfer, the rate of heat transfer between two objects depends directly on the fourth power of the temperature difference between them, as shown by the Stefan-Boltzman law. Thus, the radiation-based system of the type disclosed herein is very sensitive to small temperature differences throughout the paraboloidal reflector surface. Colder areas of the reflector surface will therefore absorb much more radiant energy and so become heated faster than will warmer areas of the paraboloidal reflector 10.

Since ice or snow 57 on the front surface of the paraboloidal reflector 10 (see FIG. 5B) remains at a constant temperature (32° F. or 0° C. at standard atmospheric pressure) as it melts, absorbing its heat of fusion, the immediately underlying paraboloidal reflector surface is also maintained at that temperature until melting is complete. Areas of the front surface of the paraboloidal reflector that are free of ice or snow 57 become heated faster, since the air 58 in contact with the surface is much less heat conductive than ice or snow and thus cannot carry away the heat as quickly. Therefore, the colder areas of the paraboloidal reflector immediately underlying any unmelted ice or snow will preferentially absorb more radiant energy and thus more heat; as a result, the heat is directed exactly where it is needed without the use of any additional energy control and distribution system. This uniform heating of the paraboloidal reflector minimizes thermal distortion of the reflector surface.

With the prior art conduction and/or convection type of heating systems, such as electrical resistance heater or hotair heater systems, the amount of heat input is independent of the amount of heat needed by any particular area of the paraboloidal reflector surface. In conduction and convection systems, the rate of heat transfer depends directly on the first power of the temperature difference between the heat source and the object to be heated. Therefore, these types of systems are much less sensitive to the temperature differences between the areas of the paraboloidal reflector still covered by ice or snow and the areas free of ice or snow, and hence are much less responsive to the variations in heat input needed by the various areas of the paraboloidal reflector surface.

These systems supply heat energy much more indiscriminately to all areas of the paraboloidal reflector surface, with the result that unless a complicated and expensive control and distribution system is used, much more of the energy supplied by the heat source is wasted into the atmosphere, rather than being used to melt ice or snow on the front surface of the paraboloidal reflector. Consequently, such systems are less efficient in energy consumption than the radiant heating system invention disclosed herein. Further, such prior-art systems must operate longer before completely melting the ice or snow on the paraboloidal reflector; this results in higher energy usage and leads to greater risk or longer periods of degraded antenna performance due to presence of ice or snow on the antenna's reflecting surface. In addition, greater thermal distortion of the paraboloidal reflector surface is caused due to less even heating. All the above problems are solved by using the above-described radiation-based arrangement, in accordance with the system of this invention.

Figure 3B:
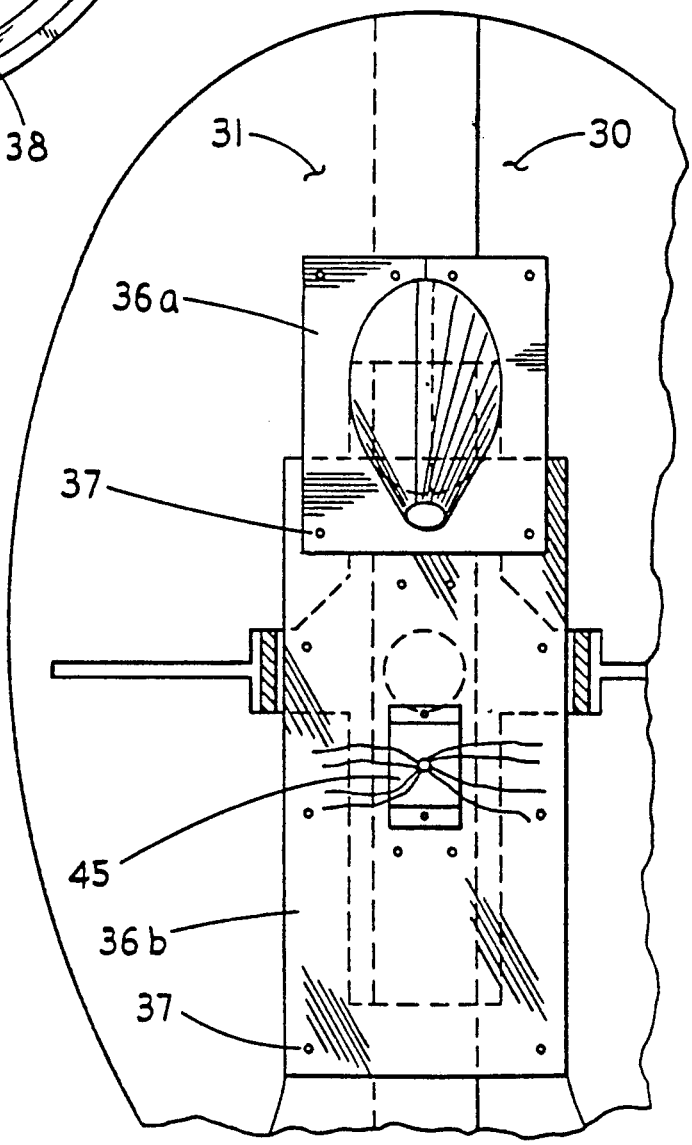

In order to control the supply of power to the infrared lamps or metal elements 44, at least one electrical power and control box 45 (see FIG. 3B) is mounted on the outside of the panel 30 and/or 31. Alternatively, the control box may be mounted on the outside of access cover plates 36*a* and/or 36*b*. Within the control box, a conventional thermostat control senses the ambient temperature and energizes the radiant heating units 42 and 43 whenever the ambient temperature is within a selected "icing" range, e.g., 22° F. to 38° F. When the ambient temperature is outside the selected "icing" range, the thermostat control de-energizes the heating units.

Suitable radiant heating units for use with a 1.8-meter antenna are tubular quartz heat lamps, or metal element radiant heaters, having a total wattage of approximately 1700 watts. These heating units have an average service life of 5000 hours in normal operation for the quartz heat lamps or at least 10,000 hours in normal operation for the metal element radiant heaters. If desired, the heating unit life can be extended by using a moisture sensor to supply power to the heating units only when the humidity is above a selected level in conjunction with an ambient temperature within the "icing" range.

It should be noted that the anti-icing and de-icing system of this invention has a narrow profile, which means that it adds little to the wind load of the antenna.

The anti-icing and de-icing system of this invention may be used on subreflectors as well as the main reflector of microwave antennas. Subreflectors may have either concave or convex reflecting surfaces, and main reflectors may be either one-piece or made up of several pieces. In each of these cases, the panels 30 and 31, the associated insulation material 50, the highly reflective mirror surface material 52 or insulated sheathing 53, and the highly reflective mirror surface 51 can be molded or otherwise shaped to conform to the shape of the particular subreflector, the one-piece main reflector, or the main reflector pieces to be used.

We claim:

1. An anti-icing and de-icing system for a reflector-type microwave antenna having a paraboloidal reflector for launching and receiving microwave signals, said system comprising a thermally non-conductive enclosure forming an enclosed cavity adjacent the rear surface of said reflector, radiant heating means within said enclosure for heating the rear surface of said reflector with radiant energy emanating in a range of directions from said heating means in such a way that the air in said cavity is in turn heated by heat transferred to said air from the rear surface of said reflector, and means within said enclosure for directing the radiating energy emanating from said heating to said rear surface of said paraboloidal reflector, said heating means having a front side facing said rear surface of said flector and said directing means further comprising means for diverting at least a portion of the radiant energy emanating from said front side of said heating source and dispersed said diverted energy across the rear surface of said paraboloidal reflector.

2. The system of claim 1 wherein said diverting means is in the form of a reflecting mirror surface material placed on sections of the rear surface of the paraboloidal reflector in front of said heat source.

3. The system of claim 1 wherein said non-conductive enclosure comprises a non-conductive, insulated shell covering the rear surface of said reflector, with the periphery of said shell being attached to the periphery of said reflector and the remainder of said shell being spaced from the rear surface of said reflector.

4. The system of claim 3 wherein said non-conductive enclosure comprises a pair of panels attached to said reflector around the periphery of the reflector, the main body portions of said panels being spaced away from the rear surface of said reflector to form said enclosed cavity, and means fastening the two panels together across the rear surface of said reflector.

5. An anti-icing and de-icing system for a reflector-type microwave antenna having a paraboloidal reflector for launching and receiving microwave signals, said system comprising a thermally non-conductive enclosure forming an enclosed cavity adjacent the rear surface of said reflector, radiant heating means within said enclosure for heating the rear surface of said reflector with radiant energy emanating in a range of directions from said heating means is such a way that the air in said cavity is in turn heated by heat transferred to said air from the rear surface of said reflector, said heating means comprising at least one infrared heating source, and means within said enclosure for directing the radiating energy emanating from said heating means to said rear surface of said paraboloidal reflector, said directing means comprising reflective mirror surface material placed (i) on the rear of said reflector in the areas directly opposed to the intra-red heating source, and (ii) on the entire inside surface of said non-conductive enclosure.

6. A microwave antenna comprising the combination of a metal reflector for transmitting and receiving microwave energy, a thermally non-conductive enclosure fastened to said reflector and forming an enclosed air cavity adjacent to the rear surface of said reflector, a radiant heat source within said cavity for heating the rear surface of said reflector with radiant energy emanating in a range of directions from said source, in such a way that the entire front surface of said reflector is heated by conduction and the air within said cavity is heated by conduction and convection from the rear surface of said reflector, and means within said cavity for directing the radiating energy emanating from said heat source to said rear surface of said paraboloidal reflector, said heating means having a front side facing said rear surface of said reflector and said directing means further comprising means for diverting at least a portion of the radiant energy emanating from said front side of said heating source and dispersing said diverted energy across the rear surface of said paraboloidal reflector.

7. The system of claim 6 wherein said diverting means is in the form of a reflecting mirror surface material placed on sections of the rear surface of the paraboloidal reflector in front of said heat source.

8. The system of claim 6 wherein said non-conductive enclosure comprises a non-conductive, insulated shell covering the rear surface of said reflector, with the periphery of said shell being attached to the periphery of said reflector and the remainder of said shell being spaced from the rear surface of said reflector.

9. The system of claim 8 wherein said non-conductive enclosure comprises a pair of panels attached to said reflector around the periphery of the reflector, the main body portions of said panels being spaced away from the rear surface of said reflector to form said enclosed cavity, and means fastening the two panels together across the rear surface of said reflector.

10. A microwave antenna comprising the combination of a metal reflector for transmitting and receiving microwave energy, a thermally non-conductive enclosure fastened to said reflector and forming an enclosed air cavity adjacent to the rear surface of said reflector, a radiant heat source within said cavity for heating the rear surface of said reflector with radiant energy emanating in a range of directions from said source, in such a way that the entire front surface of said reflector is heated by conduction and the air within said cavity is heated by conduction and convection from the rear surface of said reflector, said heating means comprising at least one infra-red heating source, and means within said cavity for directing the radiating energy emanating from said heat source to said rear surface of said paraboloidal reflector, said directing means comprising reflective mirror surface material placed (i) on the rear of said reflector in the areas directly opposed to the infra-red heating source, and (ii) on the entire inside surface of said non-conductive enclosure.

11. An anti-icing and de-icing system for a reflector-type microwave antenna having a paraboloidal reflector for launching and receiving microwave signals, said system comprising a thermally non-conductive enclosure forming an enclosed cavity adjacent the rear surface of said reflector, a radiant heat source within said enclosure for heating the rear surface of said reflector with radiant energy in such a way that the air in said cavity is in turn heated by heat transferred to said air from the rear surface of said reflector, and reflective mirror surface material placed (i) on the rear surface of said reflector in the area directly opposed to the said heating source, and (ii) on the inside surface of said non-conductive enclosure, for directing the radiant energy emanating from said heat source across the rear surface of said paraboloidal reflector.

* * * * *